United States Patent [19]

Buschulte et al.

[11] Patent Number: 4,718,243

[45] Date of Patent: Jan. 12, 1988

[54] HEAT PUMP SYSTEM AND A METHOD OF OPERATING SAME

[75] Inventors: Winfried Buschulte, Neuenstadt a.K.; Lutz Mardorf, Hardthausen, both of Fed. Rep. of Germany

[73] Assignees: Deutsche Forschungs- und Versuchsanstalt fur Raumfahrt e.V., Cologne; Mobile Oil AG, Hamburg, both of Fed. Rep. of Germany

[21] Appl. No.: 865,173

[22] Filed: May 20, 1986

[30] Foreign Application Priority Data

May 22, 1985 [DE] Fed. Rep. of Germany ..... 3518276

[51] Int. Cl.[4] ..... F25B 15/00

[52] U.S. Cl. ..... 62/101; 62/141; 62/476

[58] Field of Search ..... 62/101, 141, 476

[56] References Cited

U.S. PATENT DOCUMENTS

| | | | |
|---|---|---|---|
| 4,448,596 | 5/1984 | Van der Sluys et al. | 62/101 |
| 4,464,907 | 8/1984 | Mack et al. | 62/101 |
| 4,526,009 | 7/1985 | Van der Sluys et al. | 62/101 |
| 4,567,736 | 2/1986 | Van der Sluys et al. | 62/476 |
| 4,619,119 | 10/1986 | Dijkstra et al. | 62/476 X |
| 4,622,830 | 11/1986 | Holldorff | 62/476 X |

FOREIGN PATENT DOCUMENTS

| | | |
|---|---|---|
| 2856767 | 7/1980 | Fed. Rep. of Germany . |
| 3149005 | 12/1981 | Fed. Rep. of Germany . |
| 3332020 | 5/1984 | Fed. Rep. of Germany . |
| 3233649 | 9/1985 | Fed. Rep. of Germany . |

*Primary Examiner*—Lloyd L. King

*Attorney, Agent, or Firm*—Wolf, Greenfield & Sacks

[57] ABSTRACT

The invention relates to a method of operating a heat pump system in an absorption heat pump mode and/or boiler heating mode. According to this method, a solution of a refrigerant in a solvent is heated in a boiler, the evaporated refrigerant is delivered either directly to an absorber through a condenser, a throttle and an evaporator when the system is operated in the heat pump mode, or directly to an absorber when the system is in the boiler heating mode. The refrigerant is combined with the solvent that is drawn, low in refrigerant, from the boiler. The rich solution thus obtained is redirected to the boiler. To shut down the system, the heating of the boiler is turned off. In order to accelerate the return to operation, the invention provides that the flow line connecting the boiler with the absorber is additionally closed when the shutdown is effected and the refrigerant line from the boiler to the absorber is opened for a short time when the pressure in the boiler exceeds a predetermined maximum value, until the pressure in the boiler drops back below the maximum value.

13 Claims, 1 Drawing Figure

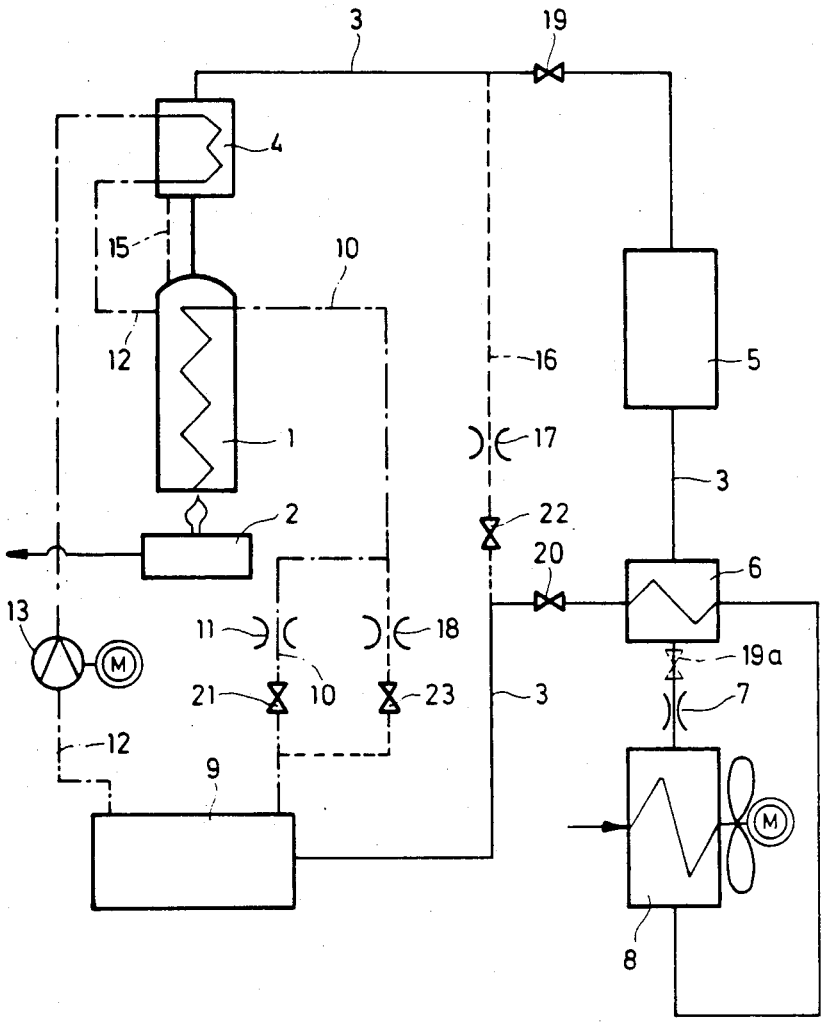
3
19
4
15
10
12
16
5
1
17
3
2
22
20
6
13
11
18
19a
21
10
23
3
7
12
9
8

HEAT PUMP SYSTEM AND A METHOD OF OPERATING SAME

BACKGROUND OF THE INVENTION

This invention relates to a method of operating a heat pump system in an absorption heat pump mode and/or boiler heating mode, wherein a solution of a refigerant in a solvent is heated in a boiler, the resultant evaporated refrigerant is delivered to an absorber through a condenser, a throttle and an evaporator when in the heat pump mode, or directly to the absorber when operating in the boiler heating mode, and wherein the refrigerant is combined with the solvent that is drawn, low in refrigerant, from the boiler and the resulting rich solution is returned to the boiler, the system being of the type allowing for its shut down by turning off the heating of the boiler.

The invention also relates to a heat pump system comprising a heated boiler, a refrigerant conduit leading from the boiler through a condenser, a throttle and an evaporator, to an absorber, further a conduit through which the solvent, low in refrigerant, is passed to the absorber, and a return conduit leading from the absorber to the boiler. The heat pump system to which the invention pertains is especially adapted to operate in accordance with the method of the present invention.

In known absorption heat pump systems, the boiler is heated by means of a gas or oil burner unit or by an electrical heater whereby refrigerant vapor is expelled from the solvent containing the refrigerant. Both pressure and temperature of the vapor are consequently elevated to a high level respectively. The vapor passes from the boiler to a condenser where it gives up the heat of condensation and condenses.

Ambient energy can be transferred in the evaporator to the highly cooled expanded refrigerant.

The refrigerant flowing from the evaporator is absorbed in an absorber into the solvent, low in refrigerant, that is drawn from the boiler. The resulting heat of solution and heat of mixing are carried off to a receiver. The enriched solution produced is pumped from the low pressure level of the absorber, (approximately evaporator pressure) to the high pressure level in the boiler.

Should the heating of the boiler be turned off, further amounts of refrigerant vapor will be expelled for some time due to the thermal capacity of the boiler until, first, the pressure equalizes between the low-pressure area and the high-pressure area, and secondly, the boiler temperature drops below the boiling point. In the meantime, the stratified concentration in the boiler is reduced and brought down to the lean solution level. In order to bring the process back into operation, the boiler temperature must be elevated by the heating energy, first to the boiling state and then to the level corresponding to the high pressure required. During that intermittent starting procedure, the concentration stratification necessary for a steady working condition in the boiler can only be restored through a progressive supply of the rich solution. Start-up time of considerable length, and energy losses must also be tolerated when such a system is to be returned to operation.

SUMMARY OF THE INVENTION

It is an object of the invention to eliminate the delays and energy losses concomitant with the return of a heat pump system to operation.

Another object of the invention is to improve a heat pump system of the above-defined art so it can be operated according to the above-described method.

According to one aspect of the invention, when the system of the above-defined art is to be shut down, a flow line connecting the boiler with the absorber is closed additionally; moreover, when the pressure in the boiler exceeds a maximum value, a refrigerant flow line leading from the boiler to the absorber is opened for a short time until the pressure in the boiler drops back below the maximum value.

According to another aspect of the invention, closing means is provided in the flow lines between the boiler and absorber, which closing means can be closed for an extended period of time, simultaneously with the boiler heating being turned off.

BRIEF DESCRIPTION OF THE DRAWING

The method and the system of the invention is apparent from the accompanying drawing presenting a diagram of the system.

DETAILED DESCRIPTION OF THE METHOD

Referring to the first aspect of the invention described above, the high-pressure section of the system (boiler, condenser) is to be separated from the low-pressure section of the system (evaporator, absorber) to preclude a pressure equalization between the high-pressure and low-pressure sections of the system after the shut-down. Since the production of refrigerant vapor continues due to the thermal capacity of the boiler after the shut-down, the invention provides that the flow line from the boiler to the absorber is opened for a short time to avoid an excessive pressure build-up in the boiler. Thus, an excess pressure can be relieved through that flow line; however, the release is in effect for only a short period of time, sufficient for the pressure in the high-pressure section to drop to a point below a critical maximum pressure value but not to the level of pressure prevailing in the low-pressure section of the system.

It is also advantageous to maintain the maximum pressure value equal to or higher than the operating pressure of the boiler.

The flow line will be closed again whenever the pressure reaches a minimum value that is, in every case, above the standstill pressure which would prevail if an equalization of pressure between the boiler and absorber were possible.

The method described herein lends itself to use not only for a system operated in the typical absorption heat pump mode, but also for a system operated in the boiler heating mode in which the refrigerant is fed from the boiler directly to the absorber, by-passing the condenser and the evaporator. The above-mentioned pressure equalization can be prevented even in this case. Thus, when the system is to be returned to operation, it can start up from boiler conditions that correspond, at least significantly, to the operating conditions. Moreover, it is not significant whether the system has been operated in the boiler heating mode or in the heat pump mode before the shut-down.

It is advantageous to stop the refrigerant flow between the boiler and the condenser and between the evaporator and absorber when the system, operating in the heat pump mode, is shut down, and when the pressure in the boiler exceeds the maximum limit to open momentarily the flow route between the boiler and condenser only, while keeping closed the flow line between the evaporator and absorber. In the event that pressure in the boiler exceeds the maximum value, the refrigerant can flow to the condenser which results in a pressure drop in the boiler. Nevertheless, the above provision further enables the low-pressure section to be fully separated from the high-pressure section.

It has also proven profitable to open at first only the solvent flow line to the absorber and the flow line of the rich solution to the boiler when the system is turned on, while the refrigerant line from the boiler to absorber is not opened until the pressure and temperature in the boiler due to its heating reach at least approximately the operating pressure and/or operating temperature level. In this way, steady operating conditions can be reached particularly quickly.

To operate the system in the boiler heating mode, a bypass line is provided directly from the boiler to the absorber. A further closing means which can be closed simultaneously with the boiler heating being turned off is installed in the bypass line.

In a system operating in the heating mode, the closing means can be provided in the refrigerant line between the boiler and condenser and a second closing means, closable for an extended period simultaneously with the boiler heating being shut down, is provided between the evaporator and absorber.

In a modified embodiment of the invention, the closing means may be disposed in the refrigerant line also upstream from the throttle and downstream of the condenser, but in such a case no second closing means is needed.

Preferably, the closing means in the refrigerant line from the boiler to the absorber is a pressure relief valve which maintains the pressure in the boiler at or below a predetermined maximum value but on the other hand, the valve prevents the boiler pressure from ever dropping below a predetermined minimum value.

It is particularly advantageous when the closing means in the bypass line is open in the no-flow situation. This ensures that no excess pressure develops in the boiler in case of power failure or other breakdowns which would cause an unexpected shut-down of the system.

DETAILED DESCRIPTION OF THE SYSTEM

The invention will now be explained in still more detail by the following description of a preferred embodiment of the system of the invention.

The expeller or boiler 1 is heated by heating means 2, for instance a gas or oil burner. The boiler 1 holds a mixture of a solvent and refrigerant dissolved therein. The heating causes the refrigerant in the boiler to evaporate whereupon the vapor passes via a refrigerant line 3, first to a rectifier 4 and then through a condenser 5, an aftercooler 6, a throttle 7, an evaporator 8, then via a further pass through the aftercooler 6 and to an absorber 9.

The solvent that remains in the boiler, low in refrigerant, is also directed to the absorber 9 by way of a solvent conduit or line 10 and a throttle 11.

A return conduit or line 12 with a pump 13 installed therein leads from the absorber 9 via the rectifier 4 to the boiler 1. The rectifier 4 is provided with a reflux line 15 for condensed refrigerant.

The described system is suitable to be operated in a typical heat pump mode. In order to render the system operable also in the so-called boiler heating mode, a bypass line 16 is provided, which allows the refrigerant from the rectifier 4 to be passed directly to the absorber 9. The bypass line includes a throttle 17 installed therein. Moreover, another throttle 18 is installed in the solvent line 10 parallel to the throttle 11.

Stop valves, essential operational components of the system, are installed in the individual lines as follows. A stop valve 19 is installed in the refrigerant line 3 between the rectifier 4 and condenser 5, downstream from the branching of the bypass line 16; another stop valve 20 (also referred to as "second closing means") is installed between the aftercooler 6 and absorber 9 upstream from the merger point of the bypass line 16; a stop valve 21 is mounted on the solvent line 10 between the throttle 11 and the absorber 9. Another stop valve 22 (also referred to as "bypass closing means") is installed in the bypass line 16 between the throttle 17 and the merger point of the line 16 with the refrigerant line 3, and still another stop valve 23 is provided in the solvent line between the throttle 18 and the absorber 9.

In a modified embodiment of the invention, supplementary closing means of the type of a single valve **19*a* is installed, instead of the valves 19 and 20, in the line 3 upstream of the throttle 7 and downstream of the condenser 5. The valve 19*a* is shown in broken lines in the drawing. When the above-described system is in operation, refrigerant vapor is expelled in a known way from the solvent due to the heating 2. In the heat pump mode, the vapor passes through the rectifier in which it is further separated from the solvent, to the condenser 5 in which condensation takes place with simultaneous heat emission. The liquefied refrigerant then expands and is evaporated again in the evaporator 8, using the ambient heat energy. The evaporator may be provided with a power-driven ventilator in a manner such as indicated in the drawing. The evaporated refrigerant, still under low pressure, passes into the absorber. The refrigerant-lean solution, after expansion, is passed through the solvent line 10 to the throttle 11. Both lean solution and refrigerant vapor combine in the absorber whereby mixing heat and solution heat are given up. The rich solution thus produced is redirected to the boiler via the power-driven pump 13** and the rectifier.

When the system is to be operated in the boiler mode rather than in the heat pump mode, the refrigerant is fed to the absorber via the bypass line only, whereby it is expanded in the throttle 17 to a lower pressure. In this case, the lean solution is fed to the absorber through the throttle 18 rather than through the parallel throttle 11, the throttling effect of which is greater than that of the throttle 18. The throttling effects of the throttle 17 in the bypass line and 18 in the refrigerant line are synchronized with each other.

It is possible to control the stop valves 19 thru 23 so that the system works either in the heat pump mode or in the boiler mode. In the heat pump mode, the valves 19, 20 and 21 are opened and the valves 22 and 23 are closed. In the boiler mode the situation is reversed.

When the system is shut down, the heating unit 2 as well as the motors of the pump 13 and the evaporator fan are disengaged first, and furthermore all the stop valves 19 thru 23 are closed also. Due to these valves being closed and the pump 13 being at a standstill, the high-pressure section of the system (boiler, rectifier, condenser) becomes separated from the low-pressure section (absorber, evaporator) so that upon the shut-down the pressure between both sections can no longer equalize.

Since the thermal capacity of the boiler causes the refrigerant vapor to be expelled for a certain time after the heating 2 is stopped, the pressure in the boiler increases above the usual operating level. To limit the boiler pressure to the level required, the stop valve 19 and, if necessary, the stop valve 22 are designed as pressure relief valves which open when the pressure exceeds a maximum level and close when the pressure drops back to a minimum level. The maximum pressure level is preferably above the operating pressure prevailing during steady operation, and the minimum pressure is preferably below the operating level, but still substantially higher than a pressure that would be established if the high-pressure and low-pressure sections were interconnected after the shut-down. Owing to this provision, the pressure in the boiler, after its cooling down, is maintained at all times between the minimum and maximum pressure levels, wherein those values are customarily slightly below or slightly above the operating pressure.

By opening the stop valves 19 or 22, refrigerant flow is directed to the condenser (valve 19) or to the absorber (valve 22), and the refrigerant is retained therein in both cases.

The return of the system to operation may thus start from a point where the conditions within the boiler correspond largely to the operating conditions. This means that the pressure and also the stratified distribution of concentration in the boiler may be maintained to a large extent even during a standstill, owing to the separation of the high-pressure zone from the low-pressure zone of the system. Accordingly, the return to operation can be accomplished substantially faster than using conventional methods. The present method also offers energy savings.

The starting procedure can be accelerated even more by first putting into operation the solvent circuit only, i.e., by opening first only the stop valves 21 and/or 23 and starting the solvent pump 13, while the valves 19, 20 and 22 remain closed. The latter valves being opened only after the right boiler temperature is reached.

When the system is to be returned to operation, it is insignificant whether it was operated in the boiler mode or in the heat pump mode before the standstill. This is due to the separation of the high-pressure and low-pressure sections, or zones, of the system. In both cases, the status of the high-pressure section will be preserved, due to the separation, to such extent that the system can be put back into operation either in the boiler mode or the heat pump mode without a substantial delay.

We claim:

1. A method of operating a heat pump system in an absorption heat pump mode and/or boiler heating mode, comprising the steps of:

(a) heating a solution of a refrigerant in a solvent in a boiler;

(b) delivering the resultant evaporated refrigerant to an absorber through a condenser, through a throttle and through an evaporator when in the heat pump mode, or directly to the absorber when in the boiler heating mode;

(c) combining the refrigerant with the solvent that is drawn, low in refrigerant, from the boiler;

(d) returning the resulting rich solution to the boiler;

(e) providing for the system to be shut down by turning off the heating of the boiler;

(f) additionally closing the flow line connecting the boiler with the absorber when the shut-down is effected; and (g) opening the refrigerant flow line from the boiler to the absorber when pressure in the boiler exceeds a maximum value for a short period of time necessary for pressure in the boiler to drop back below the maximum level.

2. A method according to claim 1, wherein the maximum pressure value is equal to or higher than the operating boiler pressure.

3. A method according to claim 1, wherein the refrigerant flow line from the boiler to the absorber is opened only for a period of time long enough for the boiler pressure to reach a minimum value which is below the maximum pressure value.

4. A method according to claim 3, wherein the minimum pressure value is above the standstill pressure level that would prevail if an equalization of pressure between the boiler and the absorber were possible.

5. A method according to claim 1, wherein the refrigerant flow line between the boiler and the condenser and between the evaporator and absorber is closed when shut-down is effected in the heat pump operation mode, wherein the flow line is temporarily opened, in the case of the pressure in boiler exceeding the maximum value, only between the boiler and condenser, while the flow line between the evaporator and absorber remains closed.

6. A method according to claim 1, wherein at first, only the solvent flow line leading to the absorber and the rich-solution line leading to the boiler are opened when the system is turned on, while the refrigerant flow line leading from the boiler to absorber is opened only after the operating temperature level and/or operating pressure level is reached, at least approximately, in the boiler due to its heating.

7. A method according to claim 3, wherein the maximum pressure value is equal to or higher than the operating boiler pressure.

8. A method according to claim 7, wherein the minimum pressure value is above the standstill pressure level that would prevail if an equalization of pressure between the boiler and the absorber were possible.

9. A method according to claim 5, further comprising one of the following features:

(a) the maximum pressure value is equal to or higher than the operating boiler pressure;

(b) the refrigerant flow line from the boiler to the absorber is opened only for a period of time long enough for the boiler pressure to reach a minimum value which is below the maximum pressure value;

(c) the minimum pressure value is above the standstill pressure level that would prevail if an equalization of pressure between the boiler and the absorber were possible.

10. A method as claimed in claim 6, further comprising one of the following features:

(a) the maximum pressure value is equal to or higher than the operating boiler pressure;

(b) the refrigerant flow line from the boiler to the absorber is opened only for a period of time long enough for the boiler pressure to reach a minimum value which is below the maximum pressure value;

(c) the minimum pressure value is above the standstill pressure level that would prevail if an equalization of pressure between the boiler and the absorber were possible;

(d) the refrigerant flow line between the boiler and the condenser and between the evaporator and absorber is closed when shut-down is effected in the heat pump operation mode, wherein the flow line is temporarily opened, in the case of the pressure in boiler exceeding the maximum value, only between the boiler and condenser, while the flow line between the evaporator and absorber remains closed.

11. A heat pump system comprising, in combination:

(a) a heated boiler;

(b) a refrigerant conduit leading from the boiler, through a condenser, a throttle and an evaporator, to an absorber;

(c) a solvent conduit through which the solvent, low in refrigerant, can be passed to the absorber;

(d) a return conduit leading from the absorber to the boiler;

(e) closing means comprising a pressure relief valve disposed in the refrigerant, solvent and return conduits and located between the boiler and the absorber; said closing means including supplementary closing means disposed in the refrigerant conduit between the boiler and the condenser, said closing means disposed between the evaporator and the absorber, said second closing means being operatively arranged to be shut for an extended period of time simultaneously with the heating of the boiler being turned off;

(f) actuation means for causing said closing means to be shut for an extended period of time simultaneously with the boiler heating heating being turned off; and (g) a bypass conduit operating the system in the boiler heating mode which leads directly from the boiler to the absorber and including bypass closing means which can be shut simultaneously with the boiler heating being turned off.

12. A heat pump system according to claim 11 wherein the closing means disposed in the refrigerant conduit is arranged upstream of a pressure regulator and downstream of the condenser.

13. A heat pump system according to claim 11, wherein the closing means provided in the bypass line is open in the no-flow situation.

* * * * *